US005978969A

United States Patent [19]

Vinding Diers

[11] Patent Number: 5,978,969

[45] Date of Patent: Nov. 9, 1999

[54] HEADGEAR WITH INTERNAL INTERCHANGEABLE HYGIENIC LINING

[76] Inventor: Anders Frederik Ditl Vinding Diers, 33720-Landiras, Chateau de Landiras, France

[21] Appl. No.: 09/122,517

[22] Filed: Jul. 24, 1998

[30] Foreign Application Priority Data

Mar. 12, 1998 [IT] Italy ..... AN980009 U

[51] Int. Cl.[6] ..... A42C 5/02

[52] U.S. Cl. ..... 2/181.4; 2/DIG. 11

[58] Field of Search ..... 2/181.4, 181, 181.2, 2/DIG. 11

[56] References Cited

U.S. PATENT DOCUMENTS 5,101,516 4/1992 Scarnato ..... 2/181.4

5,432,955 7/1995 Plotka et al. ..... 2/181.4

5,437,062 8/1995 Douglas ..... 2/181

*Primary Examiner*—Diana Oleksa

*Attorney, Agent, or Firm*—Watson Cole Grindle Watson, PLLC

[57] ABSTRACT

An inwardly facing hook and loop fastening portion is supported by an inner peripheral portion of the head covering of the headgear approximately at the front-parietal-occipital area of a person's head. The hygienic lining comprises a plurality of portions each of which has outwardly facing hook and loop portions which engage the inwardly facing fastening portion to detachably connect the lining to the head covering. The ends of the lining portions are disposed adjacent one another so that the lining portions extend along substantially the entire inner periphery of the headgear.

1 Claim, 1 Drawing Sheet

HEADGEAR WITH INTERNAL INTERCHANGEABLE HYGIENIC LINING

SUMMARY

This invention concerns headgear provided with a strip of Velcro, preferably positioned in the frontal-parietal-occipital area of the head, against which a strip of Velcro fitted on the back of a disposable type hygienic lining which absorbs sweat from the head, adheres.

HEADGEAR WITH INTERNAL INTERCHANGEABLE HYGIENIC LINING

This patent application concerns headgear with internal interchangeable hygienic lining.

The invention in question may easily be applied to hats, sports, work or military helmets or any other type of headgear subject to impregnation by sweat when worn.

This type of headgear is generally fitted with an internal hygienic lining made with a soft absorbing material; in the case of hats this lining prevents sweat from impregnating the external fabric of the hat while in the case of sports or work helmets, the lining absorbs the sweat which generally forms abundantly under the helmet top which is made in anti-transpiring material.

The main problem of traditional headgear is that the above lining quickly and easily becomes irreversibly impregnated with sweat. The sweat impregnating this lining almost always stains the fabric of the lining resulting in a heavy odour which is easily perceived and almost always impossible to eliminate.

The hygienic interchangeable lining according to the invention has been realised in order to resolve this problem. First and foremost it should be noted that this lining is realised in bands in that sweat forms above all in the area of the forehead, the two parietal areas and the nape of the neck.

The inventive idea consists of applying a band of this kind in the headgear and to remove it when it is impregnated with sweat, replacing it with another band of the same kind; the lining in question is in other words of the "disposable" type.

In particular, the lining in question may be realised with spongy material, paper-fabric or with another soft and porous material (which effectively absorbs sweat) and which is not too expensive.

To facilitate the application of the lining to the headgear the lining is fitted with a strip of hook and loop fastener VELCRO which adheres firmly to a conforming strip of hook and loop fastener VELCRO fitted on the headgear in question. In this regard, it should be noted that the strip of hook and loop fastener VELCRO fitted in the headgear may be fitted on the front of the inner padding which some of these hats have; in the case of helmets or other headgear without padding, the strip of hook and loop fastener VELCRO may be applied directly against the material (fabric, plastic, metal etc . . . ) of which the headgear itself is made.

In addition to the preferred embodiment and within the scope of the same inventive idea, an alternative embodiment of the above interchangeable hygienic lining may be realised consisting, not of a closed band which girds the head, but of a series of two, three or more separate inserts, applied in the headgear, all at the same height, in the areas of major sweating.

For major clarity the description of the invention continues with reference to the enclosed drawings which are intended for purposes of illustration and not in a limiting sense, whereby:

Figure 1:
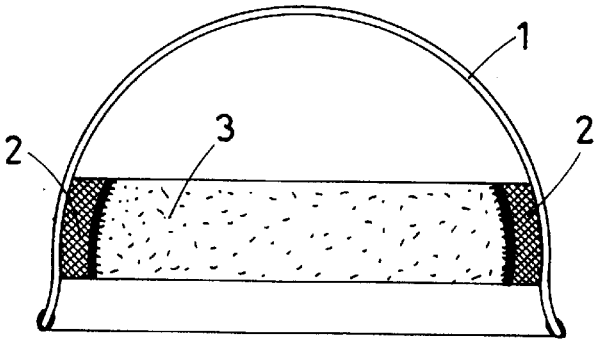
FIG. 1 is a cross-section with transverse plane of a helmet with internal padding without the interchangeable hygienic lining in question.

With reference to FIG. 1, the headgear in question (1) is provided with internal padding (2) on the front of which a perimeter strip of hook and loop fastener VELCRO (3) positioned at the height of the front-parietal-occipital area, is fitted.

This strip of hook and loop fastener VELCRO (3) is used for the fast and easy application of a band (4) made of spongy fabric, paper-fabric or another absorbing material, fitted with a conforming strip of hook and loop fastener VELCRO **(4*a*)**.

The band of the hygienic lining (4) may be removed quickly and easily from the headgear when the same is impregnated with sweat, simply by pulling it in order to separate the two strips of velcro (3 and **4*a*)**.

Figure 2:
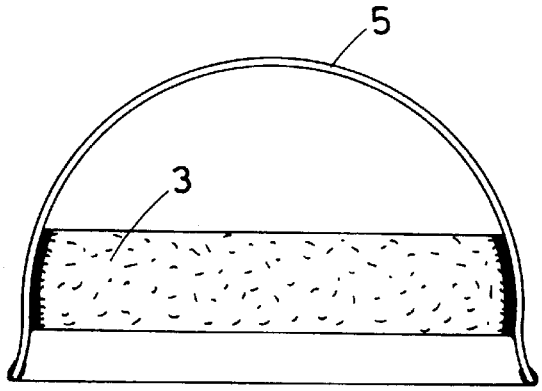
FIG. 2 is similar to the above but illustrates a helmet without internal padding.

FIG. 2 illustrates an alternative embodiment of the headgear according to the invention which in the case in question is a helmet (5) without internal padding, in which the perimeter strip of hook and loop fastener VELCRO (3), which permits attaching the above hygienic lining (4), is applied directly against the internal wall of the helmet top.

Figure 3:
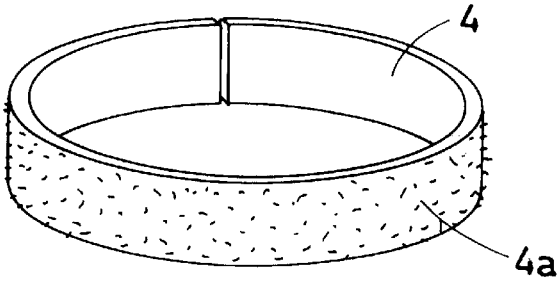
FIG. 3 is an axonometric representation of the hygienic lining in question illustrating the continuous band embodiment.
Figure 4:
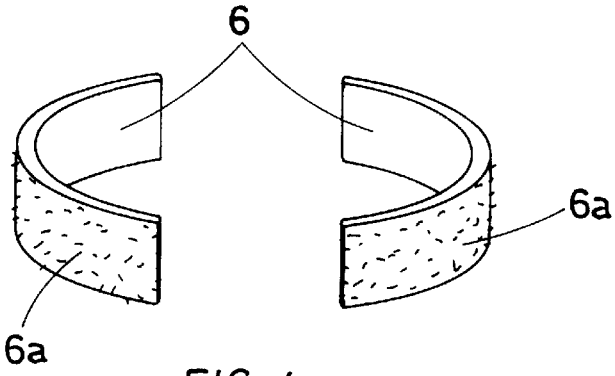
FIG. 4 is an axonometric representation of the hygienic lining in question illustrating the embodiment consisting of two separate inserts.

As mentioned previously, the lining in question may consist of a continuous band (4)—as shown in FIG. 3—or of a series of separate inserts (6)—as shown in FIG. 4—which are also applied against the strip of hook and loop fastener VELCRO (3) fitted on the headgear (which in this case may not be continuous), all at the same height and in the area of the head of major sweating.

These inserts (6) are obviously fitted with strips of hook and loop fastener VELCRO **(6*a*) which adhere to the strip of hook and loop fastener VELCRO (3)** fitted inside the headgear.

I claim:

1. A headgear with interchangeable hygienic lining comprising a head covering portion open at the bottom for receiving a person's head, said head covering portion defining a first surface facing outwardly of said headgear and a second surface facing inwardly of said headgear, said second surface having a lower part including an annular zone defining an inner periphery of said headgear, a first hook and loop fastening portion supported by said zone, said first fastening portion facing inwardly of said headgear and adapted to sit at the height of the front-parietal occipital area of a person's head positioned within the headgear, said hygienic lining comprising a plurality of lining potions having opposite ends, each of said lining portions having a further hook and loop fastening portion supported thereon and facing outwardly of said headgear, said further fastening portions being detachably connected to said first fastening portion for holding said hygienic lining portions in position with the ends thereof adjacent one another so that said lining portions extend along substantially the entire periphery of said headgear, said first fastening portion being secured to internal padding which is secured to said zone.

* * * * *